United States Patent [19]

Livick

[11] 4,349,197

[45] Sep. 14, 1982

[54] MATCHING GAME

[76] Inventor: Lester R. Livick, 15106 Beatty St., San Leandro, Calif. 94579

[21] Appl. No.: 215,271

[22] Filed: Dec. 11, 1980

[51] Int. Cl.[3] ..... A63F 9/00; G09B 19/00

[52] U.S. Cl. ..... 273/1 GF; 273/DIG. 27; 434/259

[58] Field of Search ..... 273/1 G, 1 GC, 1 R, 273/1 GD, 1 GF, DIG. 27, 272, 287, 86 R; 434/259; 368/320

[56] References Cited

U.S. PATENT DOCUMENTS

| | | | |
|---|---|---|---|
| 47,491 | 4/1865 | Edson | 273/287 |
| 1,103,369 | 7/1914 | Montessori | 434/259 X |
| 2,057,603 | 10/1936 | Wossilek | 273/287 X |
| 2,185,556 | 1/1940 | Johnson | 273/287 X |
| 2,377,100 | 5/1945 | Patterson | 434/259 |
| 2,659,163 | 11/1953 | Albee | 434/259 X |
| 2,779,599 | 1/1957 | Lansing | 273/DIG. 27 X |
| 3,471,149 | 10/1969 | Glass et al. | 273/1 GF |
| 3,500,556 | 3/1970 | Moskowitz | 434/259 |
| 3,710,455 | 1/1973 | Liversidge | 273/1 GF X |
| 4,149,717 | 4/1979 | Seijiro | 273/1 GF |

FOREIGN PATENT DOCUMENTS

| | | | |
|---|---|---|---|
| 1048582 | 8/1953 | France | 368/230 |
| 370080 | 4/1932 | United Kingdom | 434/259 |
| 600977 | 4/1948 | United Kingdom | 368/230 |
| 1109819 | 4/1968 | United Kingdom | 434/259 |
| 1246436 | 9/1971 | United Kingdom | 434/259 |

OTHER PUBLICATIONS

Sears Roebuck & Co., 1975 Xmas Catalog, p. 532, 12-1975, #1 Delux Scrabble.

*Primary Examiner*—Paul E. Shapiro

*Attorney, Agent, or Firm*—Alvin E. Hendricson

[57] ABSTRACT

A game of identification of shapes and identities particularly adapted for blind children has a rotatable housing with cutouts and pegs on exterior surfaces thereof within and upon which a player places matching pieces from a large plurality of pieces adapted to be stored in the housing and retrieved through a rotatably locking door and a timer and manually operable bell on the housing provide for signalling completion or non-completion of matching operations by a player.

7 Claims, 5 Drawing Figures

MATCHING GAME

BACKGROUND OF INVENTION

There have been developed a variety of games or toys, primarily for small children, in which objects of different shapes are to be matched with apertures of like shapes. One such toy has a spherical shell with openings shaped as circles, rectangles, triangles and the like and solid objects having like configuration that are to be inserted through the openings into the interior of the shell.

The foregoing type of toy or the like is designed to assist youngsters in identifying common shapes and increasing powers of observation and relation. The present invention incorporates a large number of different shapes which in part differ only slightly so as to provide a substantial challenge particularly to a blind child who must match the objects with depressions that may have upstanding pegs therein.

SUMMARY OF THE INVENTION

The present invention is formed as an upstanding housing having a plurality of inclined sides or faces and mounted for rotation on a base so that it may be readily turned to place any desired side in facing relation to a player. One side of the housing has a door or closure member that may be turned to free same for removal to expose the interior storage volume of the housing.

Upon the separate sides of the housing there are formed depressions and/or protuberances having different shapes and sizes which are adapted to be fitted or mated with like sized and configured pieces that are adapted to be stored in the housing when not in use. A variety of different shapes and sizes of objects of "pieces" may be provided for matching with housing depressions and/or protuberances and some pieces are quite similar to others so that the correct choice of a piece to match a particular housing location is not obvious.

The present invention is particularly adapted for use by blind children and in furtherance thereof there are provided legends in braille on at least one side of the housing adjacent depressions or the like in the form of letters of the alphabet spelling out a statement such as TRY FOR WIN. The legends identify the statement and the individual letters thereof. There are also provided on the housing a timer having raised markings and a manually operable bell. The timer may be set to some predetermined time in which a player is to complete matching the pieces with depressions and protuberances with an audio signal identifying the end of such time. The bell is to be rung by a player when the matching operations have been completed.

BRIEF DESCRIPTION OF FIGURES

The present invention is illustrated as to a single preferred embodiment in the accompanying drawing, wherein.

DESCRIPTION OF PREFERRED EMBODIMENT

Figure 1:
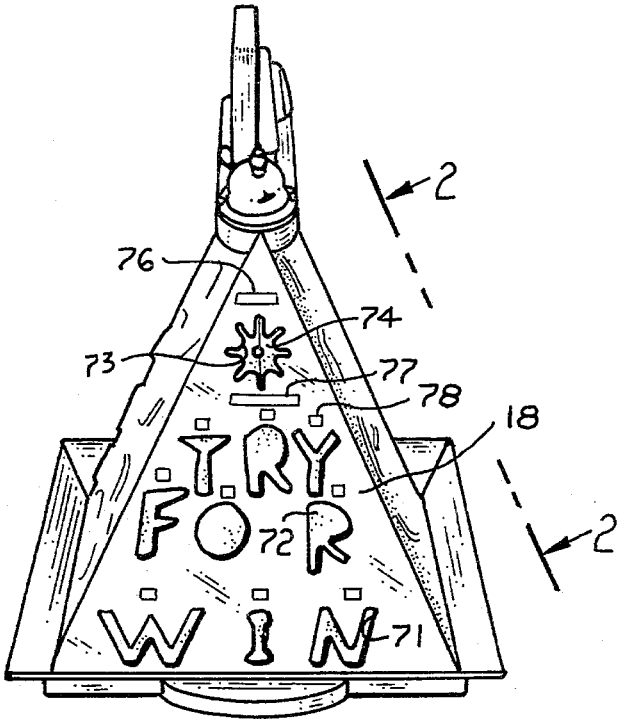
FIGS. 1–4 are perspective views of the four sides of the game of the present invention.
Figure 2:
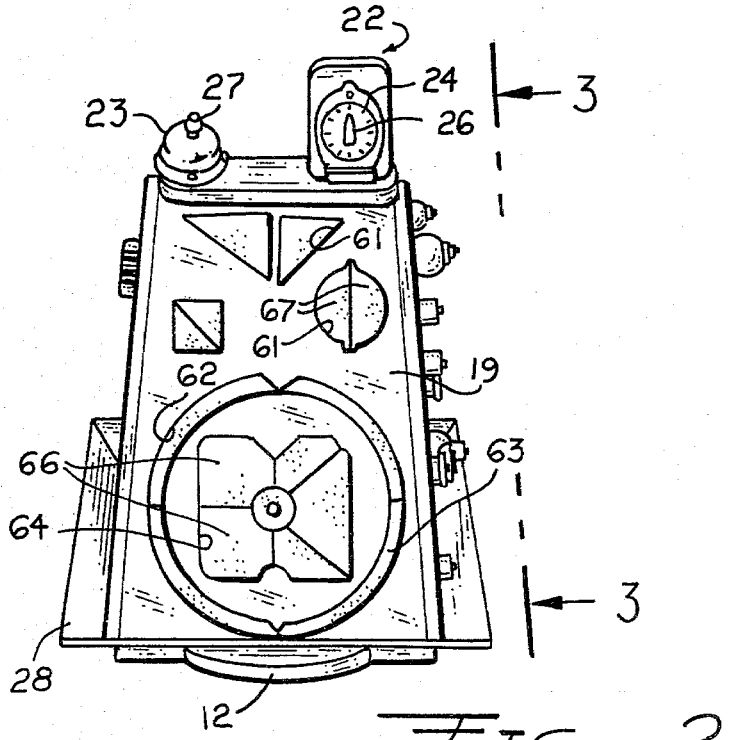
Figure 3:
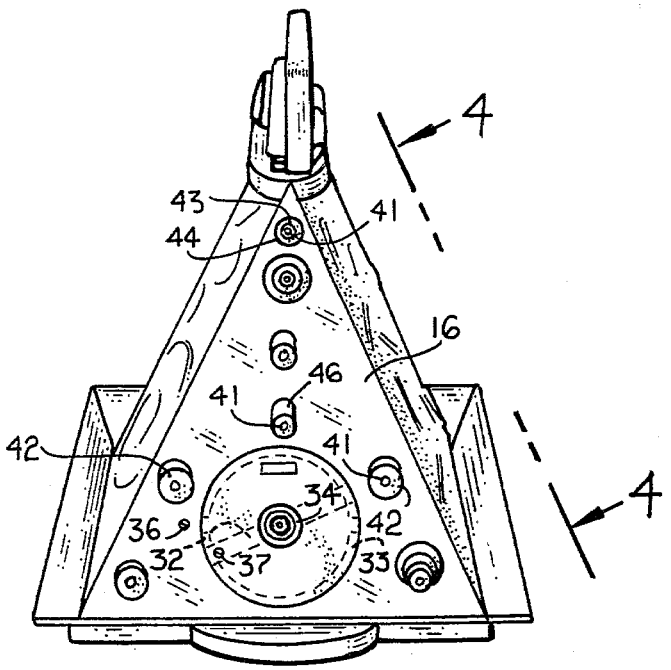
Figure 4:
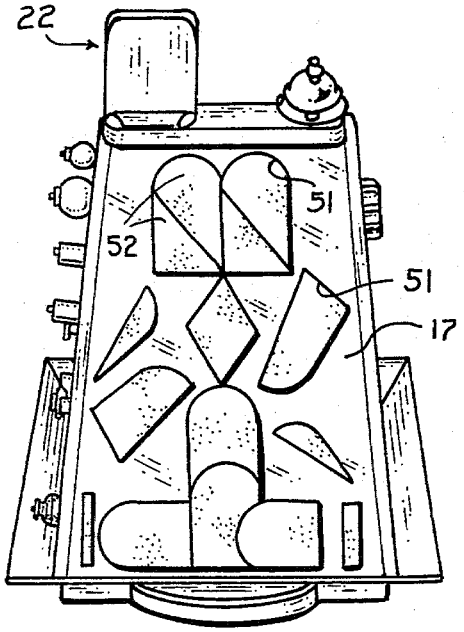
Figure 5:
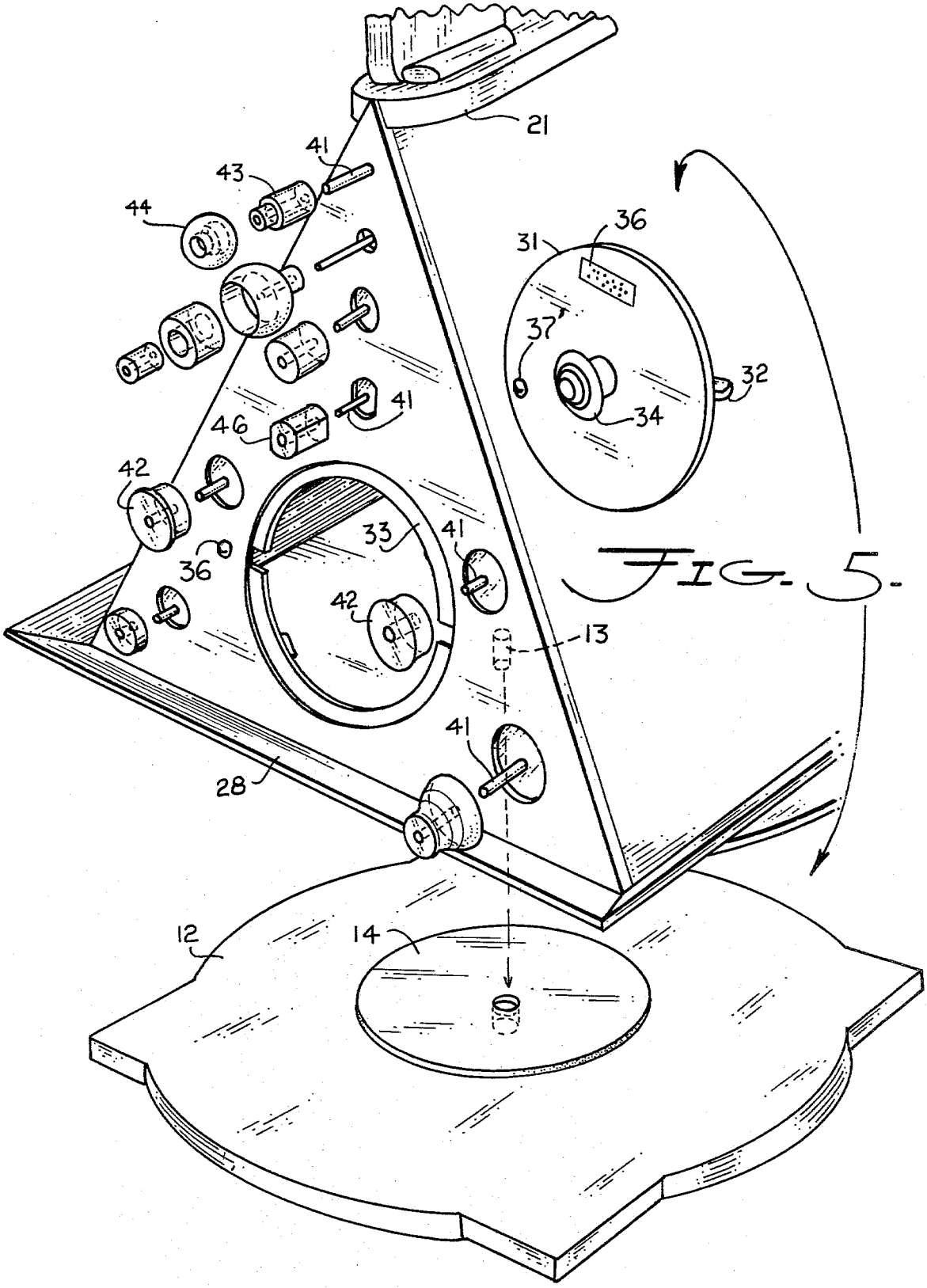
FIG. 5 is a partial exploded perspective view illustrating the relationship of elements of the game of FIGS. 1–4.

The present invention, as illustrated in the accompanying drawings, will be seen to include an upright housing 11 mounted for rotation upon a base 12 as by a central, depending pen 13 extending through a washer or the like 14 into the base. The housing has four sides, 16, 17, 17 and 19 which are inclined toward each other at the top whereat a shelf or top plate 21 closes the housing. Atop the housing on the plate of shelf 21 there are provided a timer 22 and a bell 23. The timer may take the form of a conventional cooking timer having a face with raised markings 24 thereon indicating successive minutes, for example, and a timer hand 26 adapted to be turned to a desired time indication, such as five or ten minutes, so that it then moves back to the starting point or 0 time in the stated amount of time. This timer itself may be quite conventional and thus the details thereof are not further described other than to note that the timer incorporates an audio alarm at the termination of the indicated amount of time. This may take the form of a bell that is rung or some other type of audio signal so that a blind person will be apprised of the elapse of the predetermined amount of time, as set by the timer 22. The bell 23 may be actuated by a push-buttom 27 so that a player may strike this push button 27 to ring the bell and signal the fact that he or she has completed the matching operation of the present invention.

There is furthermore provided about the bottom of the housing 11, a trough 28 having an outwardly inclined outer wall so that the trough is V-shaped in cross-section for catching and retaining items that may fall down a side of the housing. On one side 16 of the housing there is provided a door 31 which is formed of a circular disc adapted to fit into a circular opening in the housing against a rim thereabout and having lateral protuberances 32 for fitting through slots in the rim 33 so that the door may be rotated to lock same in position closing the opening in the housing. A knob or handle 34 on the door facilitates movement of same and a braille legend 36 signifying "DOOR" is placed on the door itself. There are also provided a pair of protuberances 36 and 37 with the first being disposed on the housing side 16 in alignment with a notch in the rim 33 and the second protuberance 37 being disposed on the door 31 atop the lateral projection 32 so that it is possible by sight or feel to determine when the door is properly aligned for removal or insertion. The interior of the housing 11 is hollow and floored to thus provide a storage volume for the "pieces" of the present invention described below.

On the face or side 16, for example, there are provided a plurality of pegs 41 which may have a different extent from the face and some of which may be provided in indentations in the face. There are provided pieces adapted to be fit upon these pegs 41 and to fit into the above-noted depressions, where provided. These pieces may have a variety of configurations such as the spools 42 with axial openings adapted to fit on the pegs 41 on opposite sides of door 31. The upper peg 41, for example, may be adapted to receive a pair of concentric cylinders 43–44 and another peg 41 above the door may be adapted to receive a generally rectangular piece 46 having an off-center opening therethrough and fitting into a rectangular depression in the face 16 of the housing so as to fit on the peg in only one position in order to enter the depression. Various shapes and sizes of pieces in combination thereof may be provided to fit upon pegs 41 on the face 16 and in each case a proper matching of piece and peg will result in the tip of the peg extending from the piece. Thus while it may be seen that although each of the pegs may have the same diameter, different length pegs are provided with different shaped depressions thereabout so as to properly receive only one or at most two different pieces for proper matching of piece and peg.

Other sides 17, 18 and 19 of the housing are provided with recesses 51 having distinctive configurations and sizes for receiving, in each recess, one or more pieces 52 adapted to fill the recess. An upper depression or recess 51 on face 17 may, for example, have a generally rectangular lower configuration and a double-curved upper configuration within which there are fitted mating pieces 52. A pair of other depressions which may appear to be identical are in fact of different size so that the pieces fitting same are not interchangeable. Various sizes and shapes of depressions and mating pieces may be provided on this face 17 such as illustrated.

A face 19 opposite the face 17 also contains depressions or recesses on the surface thereof, as indicated at 61, and such may include an annulus 62, for example, having unevenly spaced protuberances therein adapted to receive curved pieces 63 in only a single manner of positioning. Interiorly of the annular recess 62 there is shown to be provided a generally rectangular recess 64 having a somewhat irregular boundary and adapted to receive a plurality of pieces 66 which fit together to fill the recess. These pieces 66 may be designed to require placement in the recess 64 in some predetermined order in order to support each other during placement. One of the recesses 61 in the face 19 is shown to be generally circular but with a V-shaped extension at the top and a rectangular extension at the bottom with pieces 67 fitting together into the recess in only a single manner because projections thereon will only fit into the uneven V-shaped portion of the recess in a single way.

A final side 18 of the housing 11 is shown in the drawing to incorporate depressions 71 in the form of letters of the alphabet combined to spell out a statement such as TRY FOR WIN. The letters are preferrably somewhat irregular, as illustrated by the pieces 72 so that they will only fit into the depressions in a single way. Atop this portion of the face 18 there is provided a depression 73 in the form of an irregular cog wheel or gear piece 74, for example. Above this depression 73 at the top of the face 18 there is provided a legend 76 in braille which may set out the name of the toy or game such as "THE BRAIN" and below the depression 73 there is shown to be a further legend in braille 77 spelling out the statement "TRY FOR WIN". Above each of the letters on the face 18 there is provided a legend 78 in braille identifying the letter. It will, of course, be appreciated that the face 18 may alternatively be laid out to define some other statement; however, the general idea thereat is to set forth something of interest to a child in the form of a statement or the like with braille indicators for assistance of a blind child in matching the pieces with the recesses or depressions. It is noted that there are two capital R's on the face 18 and, as illustrated, they are formed somewhat differently so that the objects or pieces thereof are not interchangeable.

There has been described above a single preferred embodiment of the present invention wherein the inclined faces or sides of the housing contain particularly configured and sized recesses corresponding to the outline of "pieces" adapted to be matched and in fact inserted in the recesses. On one or more face of the housing the pieces may be adapted to fit upon pegs and a substantial number of recesses and pieces are provided to provide some complexity to the game or toy in order that repeated playing of same will still be of interest to a child. It is also noted that the trough around the bottom of the inclined faces is particularly provided for catching and retaining pieces that may slide down the sides as by displacement from a recess or by inadvertantly slipping from the fingers of a player. This trough is of substantial importance to a blind person for it prevents a piece from inadvertantly rolling or bouncing away from the housing so as to be unavailable for the player to match with the depression. Additionally, the housing is rotatable so that the player may remain in a single position, as for example, by being seated at a table upon which the game or toy is located and still be able to match pieces with recesses in successive sides of the housing. The internal storage space is also important in preventing inadvertant misplacement of the pieces, particularly when it is considered that the present invention is primarily directed for use by blind children.

Although the present invention has been described above with respect to a single preferred embodiment thereof, it will be apparent to those skilled in the art that numerous modifications and variations are possible within the spirit and scope of the present invention and thus it is not intended to limit the invention to the details of illustration or precise terms of description.

What is claimed is:

1. A matching game comprising an upright housing having slanting sides and a trough about the bottom thereof, the sides of said housing having indentations of different configurations, a base mounting said housing for rotation about a vertical axis, and a plurality of objects having the size and configuration of the indentations in said housing saides for placement therein by matching size and shape.

2. The game of claim 1 further defined by at least one side of said housing having pegs extending therefrom with indentations of different sizes and shapes in the side about the pegs, and further objects having openings therethrough for fitting onto said pegs and having at least ends thereof configured to mate with said different indentations.

3. The game of claim 1 further defined by a timer mounted on said housing and having a manually adjustable hand movable over a face with minute markings thereon and an audio alarm operating at the termination of adjusted times.

4. The game of claim 3 further defined by the minute markings on said face being raised so as to be discernable by touch.

5. The game of claim 3 further defined by a bell mounted atop said housing and having a manually depressible actuator whereby a player may audibly signal completion of matching objects with indentations.

6. The game of claim 1 further defined by said trough having a side projecting outwardly and upwardly from the bottom of said housing for receiving and retaining objects that may slide down the sides of said housing.

7. The game of claim 1 further defined by a door rotatably mounted in one side of said housing with at least one projection mating with a slot in the housing for opening the door in only one angular position of the door and said housing having an interior storage space for said objects communicating with said door.

* * * * *